US010818460B2

(12) United States Patent
Djogo et al.

(10) Patent No.: US 10,818,460 B2
(45) Date of Patent: Oct. 27, 2020

(54) MAGNETIC ASSEMBLY FOR GENERATING BLOW-ON CONTACT FORCE

(71) Applicant: S&C Electric Company, Chicago, IL (US)

(72) Inventors: Goran Djogo, Mount Prospect, IL (US); Richard George Smith, North Aurora, IL (US); Daniel Hunter Desmond, Chicago, IL (US)

(73) Assignee: S&C Electric Company, Chicago, IL (US)

( * ) Notice: Subject to any disclaimer, the term of this patent is extended or adjusted under 35 U.S.C. 154(b) by 0 days.

(21) Appl. No.: 16/667,395

(22) Filed: Oct. 29, 2019

(65) Prior Publication Data

US 2020/0152408 A1 May 14, 2020

Related U.S. Application Data

(60) Provisional application No. 62/760,966, filed on Nov. 14, 2018.

(51) Int. Cl.
*H01H 71/24* (2006.01)
*H01H 33/666* (2006.01)

(52) U.S. Cl.
CPC ..... *H01H 71/2454* (2013.01); *H01H 33/666* (2013.01); *H01H 71/2463* (2013.01); *H01H 2071/249* (2013.01)

(58) Field of Classification Search
CPC ..... H01H 33/666; H01H 33/6641; H01H 33/6644; H01H 33/6645; H01H 33/6662; H01H 71/2454; H01H 71/2481; H01H 71/2463; H01H 2071/249; H01H 1/54
USPC ..... 218/140, 123, 126, 129, 128, 141, 142; 310/221, 12.24, 13
See application file for complete search history.

(56) References Cited

U.S. PATENT DOCUMENTS 3,534,304 A * 10/1970 Alfred ..... H01H 77/10 335/16
4,100,519 A * 7/1978 Neff ..... H01F 7/12 137/625.65
6,580,345 B2 * 6/2003 Akita ..... H01H 33/285 218/141
2004/0217834 A1 * 11/2004 Morita ..... H01F 7/1623 335/220
2014/0210576 A1 * 7/2014 Bottcher ..... H01F 7/1615 335/170

(Continued)

*Primary Examiner* — William A Bolton

(57) ABSTRACT

A magnetic module in a circuit interrupting system is configured to generate a blow-on force that pushes a moving contact toward a stationary contact. The magnetic module includes: a coil conductor having an opening through which a moving stem of the moving contact may move, wherein the coil conductor is electrically connected to the moving stem and a first auxiliary conductor, wherein the coil conductor is configured to allow current to flow from the moving stem to the first auxiliary conductor; a plunger attached to an end of the moving stem; and a first magnetic core shaped to fit around a first section of the coil conductor, wherein the first magnetic core is configured, when current flows through the coil conductor to the first auxiliary conductor, to become magnetized, attract the plunger toward the magnetic core, and cause the moving stem of the moving contact to move toward the stationary contact.

20 Claims, 7 Drawing Sheets

(56) References Cited

U.S. PATENT DOCUMENTS

| | | | | |
|---|---|---|---|---|
| 2015/0303010 | A1* | 10/2015 | Yu | H01H 33/666<br>218/140 |
| 2015/0332880 | A1* | 11/2015 | Falkingham | H01H 9/20<br>218/142 |
| 2016/0099123 | A1* | 4/2016 | Ohda | H01H 50/74<br>335/170 |

* cited by examiner

MAGNETIC ASSEMBLY FOR GENERATING BLOW-ON CONTACT FORCE

CROSS-REFERENCE TO RELATED APPLICATION

This application claims the benefit of priority from the U.S. Provisional Application No. 62/760,966, filed on Nov. 14, 2018, the disclosure of which is hereby expressly incorporated herein by reference for all purposes.

TECHNICAL FIELD

The subject matter described herein relates generally to maintaining contact connection in higher current applications, and more particularly to systems and methods for generating a blow-on contact force driven by high current.

BACKGROUND

Blow-off force on contacts in circuit interrupting systems (e.g., switches or circuit breakers) can become excessively high, for example, for fault currents above 25 kA. As a result, a very strong contact spring and a large mechanism have been included in some vacuum switches, circuit breakers, and vacuum interrupters to counterbalance the blow-off force. This can add size, cost, and complexity to vacuum switches, circuit breakers, and vacuum interrupters.

Accordingly, it is desirable to provide systems and methods for counterbalancing the blow-off force in switches and circuit breakers that allow for the use of a smaller or no contact spring. Furthermore, other desirable features and characteristics of the present invention will become apparent from the subsequent detailed description and the appended claims, taken in conjunction with the accompanying drawings and the foregoing technical field and background.

BRIEF DESCRIPTION OF THE DRAWINGS

Embodiments of the subject matter will hereinafter be described in conjunction with the following drawing figures, wherein like numerals denote like elements, and wherein.

DETAILED DESCRIPTION

Figure 1:
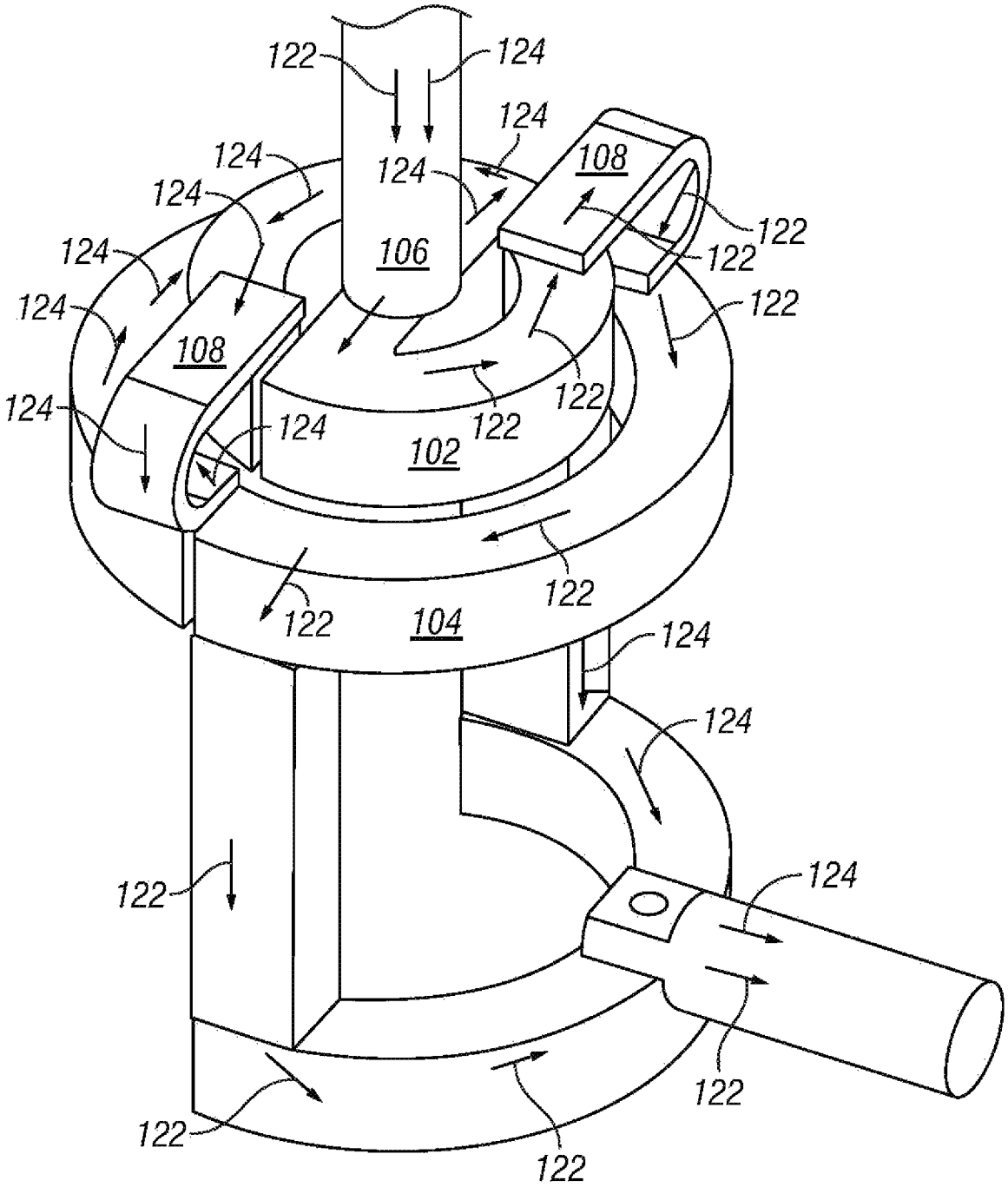
FIG. 1 is a diagram illustrating a prospective view of an example magnetic module, in the form of an example two-coil assembly, for use in a vacuum interrupter (VI) to generate a blow on force on VI contacts to counter blow-off forces on the VI contacts, in accordance with some embodiments.

The following detailed description is merely exemplary in nature and is not intended to limit the invention or the application and uses of the invention. Furthermore, there is no intention to be bound by any expressed or implied theory presented in the preceding technical field, background, or the following detailed description. As used herein, the words "exemplary" or "example" means "serving as an example, instance, or illustration." Thus, any embodiment described herein as "exemplary" or "example" is not necessarily to be construed as preferred or advantageous over other embodiments. All embodiments described herein are exemplary embodiments provided to enable persons skilled in the art to make or use the invention and not to limit the scope of the invention which is defined by the claims.

The subject matter described herein discloses apparatus, systems, methods, and techniques for using fault current in an electromagnetic assembly to produce a blow-on force on contacts of a vacuum switch, circuit breaker, or vacuum interrupter that will effectively balance the blow-off force. This can result in a much smaller contact spring or no contact spring being used to counterbalance the blow-off force on contacts and a much smaller and cheaper mechanism for vacuum switches and circuit breakers.

The subject matter described herein discloses apparatus, systems, methods, and techniques for using fault current to generate a repulsive magnetic force that can be harnessed to generate a blow-on force on contacts. The subject matter described herein also discloses apparatus, systems, methods, and techniques for using fault current to generate an attractive magnetic force that can be harnessed to generate a blow-on force on contacts.

In one embodiment, a magnetic module for generating a blow-on force using fault current is provided. The magnetic module includes a moving coil that includes a first moving coil arc section and that is attached to a moving stem of a moving contact. The magnetic module further includes a stationary coil that includes a first stationary coil arc section that is coupled to a first auxiliary conductor. The magnetic module also includes a current transfer strap positioned to electrically connect the first moving coil arc section to the first stationary coil arc section. The moving coil, stationary coil, and current transfer strap are positioned to allow current to flow from the moving stem to the first auxiliary conductor. The current transfer strap and the first auxiliary conductor are positioned to cause the current to flow in the first stationary coil arc section in a direction opposite to the current flow in the first moving coil section. The moving coil and stationary coil are positioned such that current flow through the first moving coil arc section and the first stationary coil arc section generates a force that pushes the moving coil away from the stationary coil and the moving stem of the moving contact toward a stationary contact.

In another embodiment, a magnetic module for generating a blow-on force using fault current is provided. The magnetic module includes a coil conductor having an opening through which a moving stem of a moving contact may move, wherein the coil conductor is electrically connected to the moving stem and a first auxiliary conductor, wherein the coil conductor is configured to allow current to flow from the moving stem to the first auxiliary conductor. The magnetic module further includes a plunger constructed from magnetic attractive material attached to an end of the moving stem and a first magnetic core shaped to fit around a first section of the coil conductor, wherein the first magnetic core is configured, when current flows through the coil conductor to the first auxiliary conductor, to become magnetized, attract the plunger in an axial direction toward the magnetic core, and cause the moving stem of the moving contact to move toward a stationary contact.

In another embodiment, a circuit interrupting system comprising a moving stem connected to a moving contact, a stationary contact, and a magnetic module is provided. The magnetic module is configured to generate an attractive magnetic force that pushes the moving contact toward the stationary contact using fault current. The magnetic module includes: a coil conductor having an opening through which a moving stem of the moving contact may move, wherein the coil conductor is electrically connected to the moving stem and a first auxiliary conductor, wherein the coil conductor is configured to allow current to flow from the moving stem to the first auxiliary conductor; a plunger constructed from magnetic attractive material attached to an end of the moving stem; and a first magnetic core shaped to fit around a first section of the coil conductor, wherein the first magnetic core is configured, when current flows through the coil conductor to the first auxiliary conductor, to become magnetized, attract the plunger in an axial direction toward the magnetic core, and cause the moving stem of the moving contact to move toward the stationary contact.

In another embodiment, a circuit interrupting system comprising a stationary contact, a moving stem connected to a moving contact, and a magnetic module is provided. The magnetic module is configured to generate a repulsive magnetic force that pushes the moving contact toward the stationary contact using fault current. The magnetic module includes: a moving coil that includes a first moving coil arc section and is attached to a moving stem of the moving contact; a stationary coil that includes a first stationary coil arc section that is coupled to a first auxiliary conductor; and a current transfer strap that is positioned to electrically connect the first moving coil arc section to the first stationary coil arc section. The moving coil, stationary coil, and current transfer strap are positioned to allow current to flow from the moving stem to the first auxiliary conductor. The current transfer strap and the first auxiliary conductor are positioned to cause the current to flow in the first stationary coil arc section in a direction opposite to the current flow in the first moving coil section. The moving coil and stationary coil are positioned such that current flow through the first moving coil arc section and the first stationary coil arc section generates a force that pushes the moving coil away from the stationary coil and the moving stem of the moving contact toward the stationary contact.

FIG. 1 is a diagram illustrating a prospective view of an example magnetic module for use in a vacuum interrupter (VI) in an example circuit interrupting system (e.g., circuit breaker or switch) to generate a blow on force on VI contacts to counter blow-off forces on the VI contacts. The example magnetic module is in the than of a two-coil conductor assembly 100 that generates a repulsive magnetic force that is harnessed to generate a blow-on force. The example two-coil conductor assembly 100 includes a moving coil 102 and a stationary coil 104. The example moving coil 102 is fastened to a moving stem 106 of the VI. The stationary coil 104 is electrically connected to the moving coil 102 by two flexible current transfer straps 108. The outer diameter (OD) of the moving coil 102 is smaller than the inner diameter (ID) of the stationary coil 104 to allow the moving coil 102 to move in close proximity axially to the stationary coil 104 without mechanical interference.

Figure 2A:
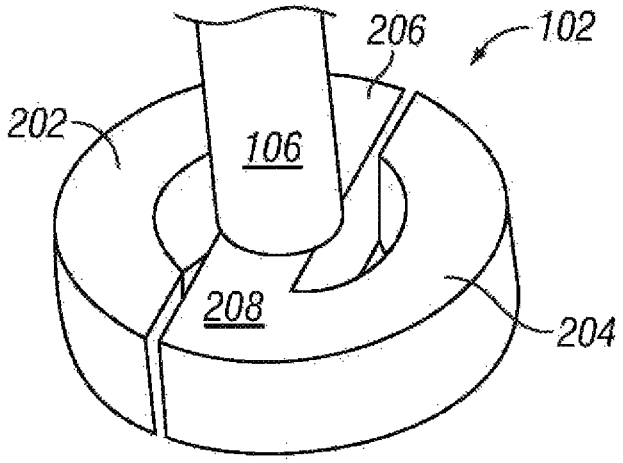
FIG. 2A is a prospective diagram of the example moving coil in the example two-coil assembly, in accordance with some embodiments.
Figure 2B:
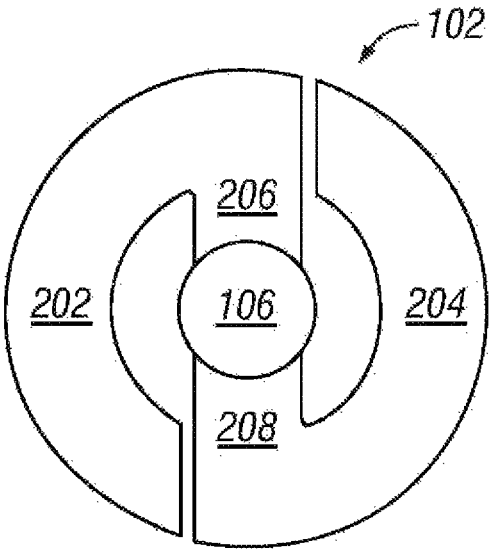
FIG. 2B is a top down view of the example moving coil in the example two-coil assembly, in accordance with some embodiments.

FIG. 2A is a prospective diagram of the example moving coil 102 and FIG. 2B is a top down view of the example moving coil 102. The example moving coil 102 includes two circumferential arc segments 202, 204. The two circumferential arc segments 202, 204 are each connected at one end to the center of the example moving coil 102 (where the VI moving stem 106 is attached), respectively, by two radial straight segments 206, 208. Each of the two circumferential arc segments 202, 204, at its other end is physically separated from the other circumferential arc segments 202, 204.

Figure 2C:
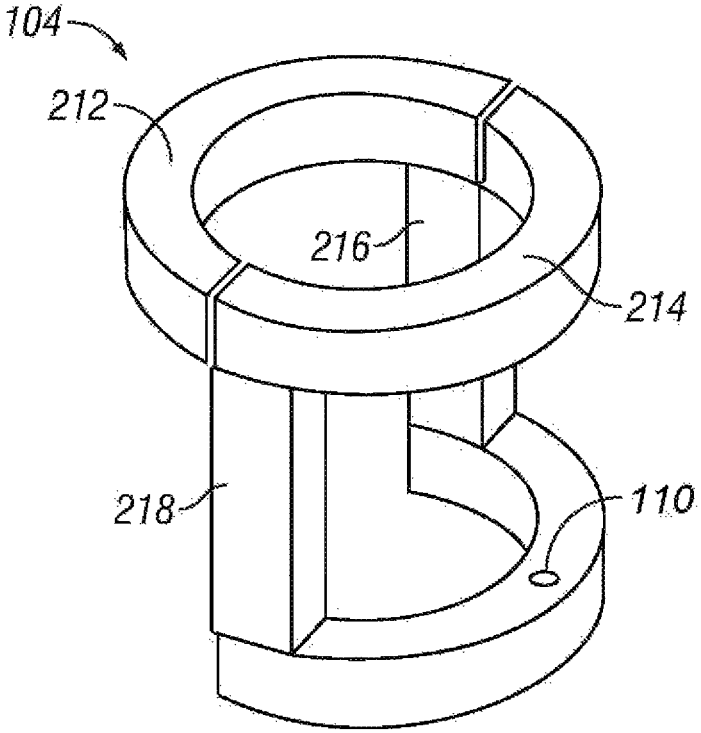
FIG. 2C is a prospective diagram of the example stationary coil in the example two-coil assembly, in accordance with some embodiments.

FIG. 2C is a prospective diagram of the example stationary coil 104. The example stationary coil 104 includes two physically separate circumferential arc segments 212, 214. Each circumferential arc segment 212, 214 is connected to the switch terminal 110 via one of auxiliary conductors 216, 218. Circumferential arc segment 212 is connected to auxiliary conductor 216, and circumferential arc segment 214 is connected to auxiliary conductor 218, in this example.

The separation of the moving coil 102 into two arc segments 202, 204 and the stationary coil 104 into two arc segment 212, 214 causes current from the VI moving stem 106 to flow along two current paths 122, 124. The direction of current along the two current paths 122, 124 through the assembly 100 is illustrated in FIG. 1. The total VI current $I_{total}$ is divided into currents of approximately equal magnitude, each of which flows through a single arc segment 202, 204 in the moving coil 102 and a single arc segment 212, 214 in the stationary coil 104.

Current directions in the coil arc segments 202, 204, 212, 214 are such that current with magnitude $I_{total}$ creates effectively a circular loop in each coil 102, 104 and current direction is opposite in the two circular loops. This results in a repulsive magnetic (Lorentz) force acting on the moving coil 102 that pushes the VI stem and creates the blow-on force pressing the VI contacts together. The Lorentz force acts as a distributed force around the arc segments 202, 204 of the moving coil 102.

Figure 3:
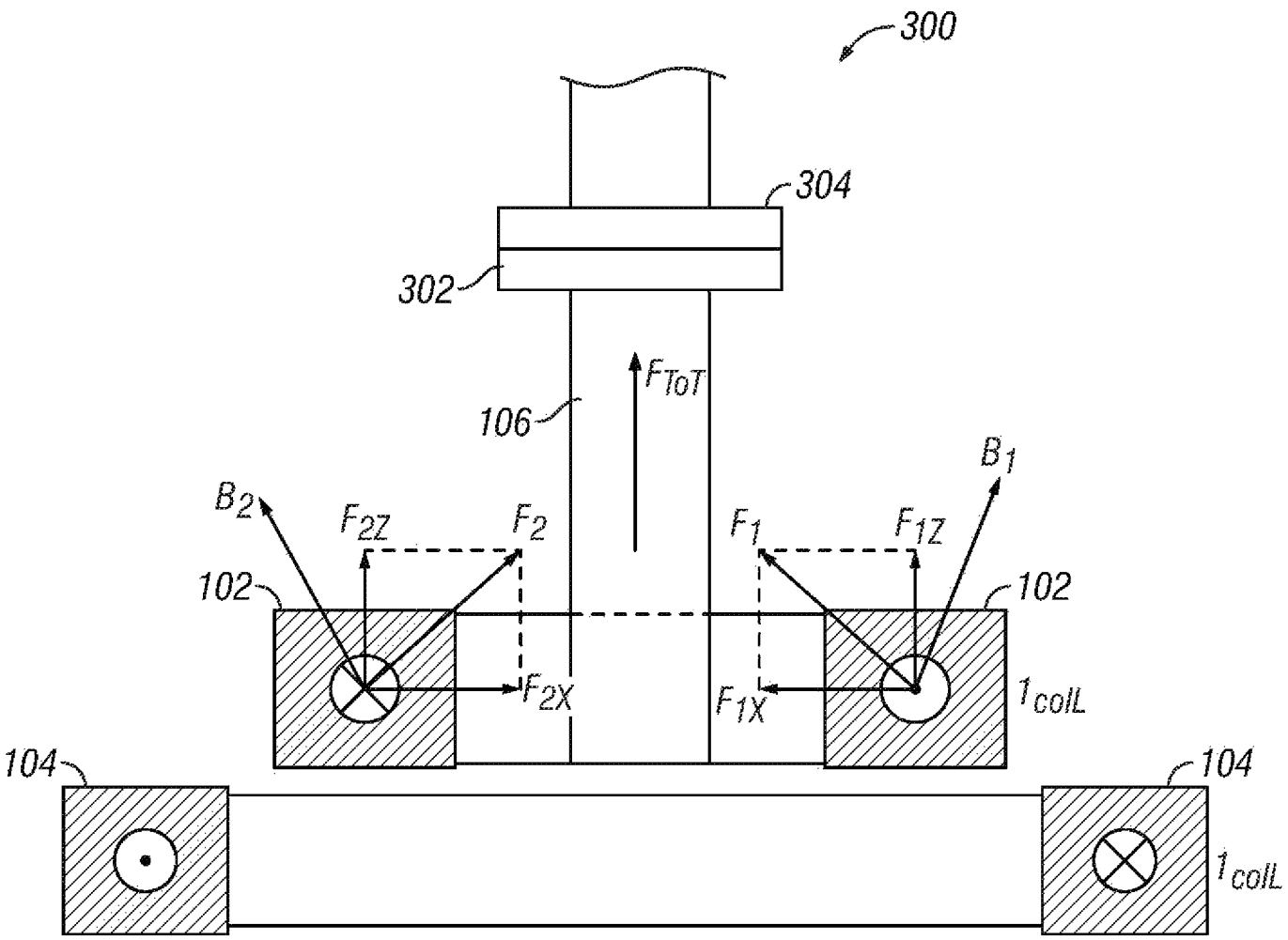
FIG. 3 is a cross sectional diagram of the example two-coil assembly that illustrates how Lorentz force components may be summed to produce a resultant blow-on force $F_{tot}$ that can cause a moving contact via the moving stem to move toward the stationary contact in the VI, in accordance with some embodiments.

FIG. 3 is a cross sectional diagram of the example two-coil assembly 100 that illustrates how Lorentz force components F1, F2 may be summed to produce a resultant blow-on force $F_{tot}$ that can cause a moving contact 302 via the moving stem 106 to move toward the stationary contact 304 in the VI 300. The Lorentz force $F_{tot}$ acting on the moving coil 102 is a distributed force around the coil 102 with a first force F1 at coil arc section 1 and a second force F2 at opposite coil arc section 2. B1 and B2 are the magnetic flux density vectors in the centers of the coil arc sections 1 and 2 and are created by current $I_{coil}$ flowing in the stationary coil. The first force F1 has radial components $F_{1x}$, $F_{1z}$ and the second force F2 has radial components $F_{2x}$, $F_{2z}$. Radial components $F_{1x}$ and $F_{2x}$ cancel out, while axial components $F_{1z}$ and $F_{2z}$ sum up. Consequently, the total resultant Lorentz force $F_{tot}$ acts in the positive axial direction as the blow-on force on the VI contacts.

Although the example two-coil assembly 100 is constructed with each coil 102, 104 having two arc segments, in other examples, the coils 104 may be constructed with a different number of arc segments such as one, three, or four. Constructing the coils 102, 104 with two arc segments provides a simple geometry that has symmetry with respect to the axis and for that reason basically negligible lateral components of the magnetic force acting on the moving coil 102 and VI stem 106. The conductor material may be copper to reduce heating due to Ohmic losses. The flexible current transfer straps may be made of laminated copper sheets.

Figure 4:
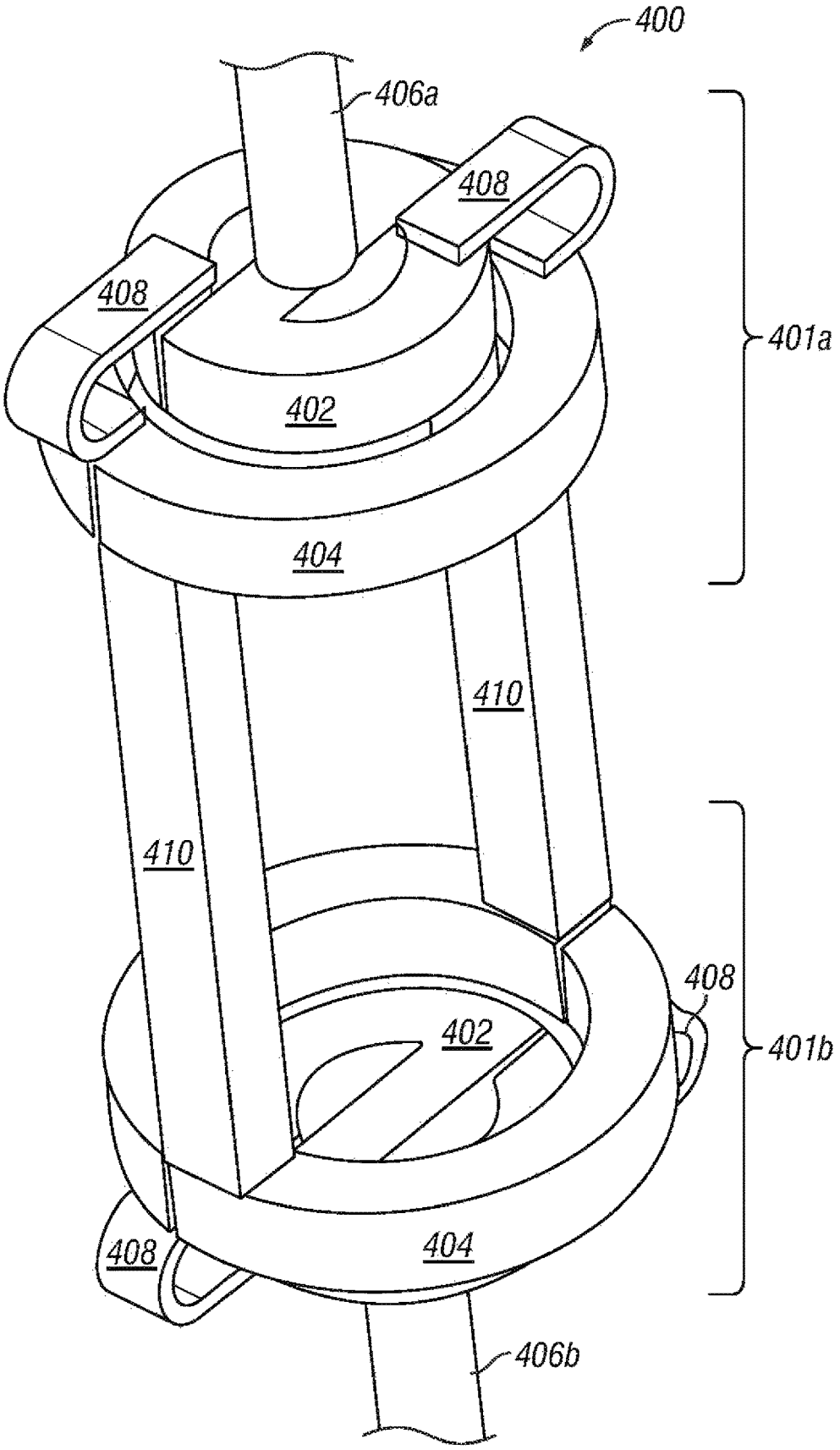
FIG. 4 is a diagram illustrating a prospective view of an example two-coil conductor assembly that can be used to produce a blow-on contact force on the contacts of two vacuum interrupters connected in series in a switch, in accordance with some embodiments.

FIG. 4 is a diagram illustrating a prospective view of an example two-coil conductor assembly 400 that can be used to produce a blow-on contact force on the contacts of two vacuum interrupters connected in series in an example circuit interrupting system (e.g., circuit breaker or switch). A separate conductor assembly 401*a*, 401*b* is attached, respectively, to a moving stem 406*a*, 406*b* of a different vacuum interrupter.

Each example conductor assembly 401*a*, 401*b* is similar to the example two-coil conductor assembly 100 in form and function. Each conductor assembly 401*a*, 401*b* includes a moving coil 402 and a stationary coil 404. Each moving coil 402 is attached at its center to a VI moving stem 406*a*, 406*b*. Each moving coil 402 is electrically connected to a stationary coil 404, for example, through flexible current transfer straps 408. The outer diameter (OD) of a moving coil 402 is smaller than the inner diameter (ID) of its associated stationary coil 404 to allow the moving coil 402 to move in close proximity axially to its associated stationary coil 404 without mechanical interference. Each example moving coil 402 includes two circumferential arc segments. Each of the two circumferential arc segments is connected at one end to the center of the moving coil 402 (where the VI moving stem 406*a/b* is attached) by a radial straight segment. Each of the two circumferential arc segments of the moving coil 402, at its other end, is physically separated from the other circumferential arc segment. Each example stationary coil 404 includes two physically separate circumferential arc segments.

Each electromagnet assembly 401*a*, 401*b*, differs from the example electromagnet assembly 100 in that auxiliary conductors 410 couple one arc section of the stationary coil 404 of one conductor assembly 401*a* to one arc section of the stationary coil 404 of the other conductor assembly 401*b*.

Current flow from one moving stem (e.g., 406*a*) to the other moving stem (e.g., 406*b*) would result in a repulsive magnetic (Lorentz) force acting on the moving coils 402 pushing the VI stems 406*a*, 406*b* and creating the blow-on forces pressing the VI contacts together.

Figure 5A:
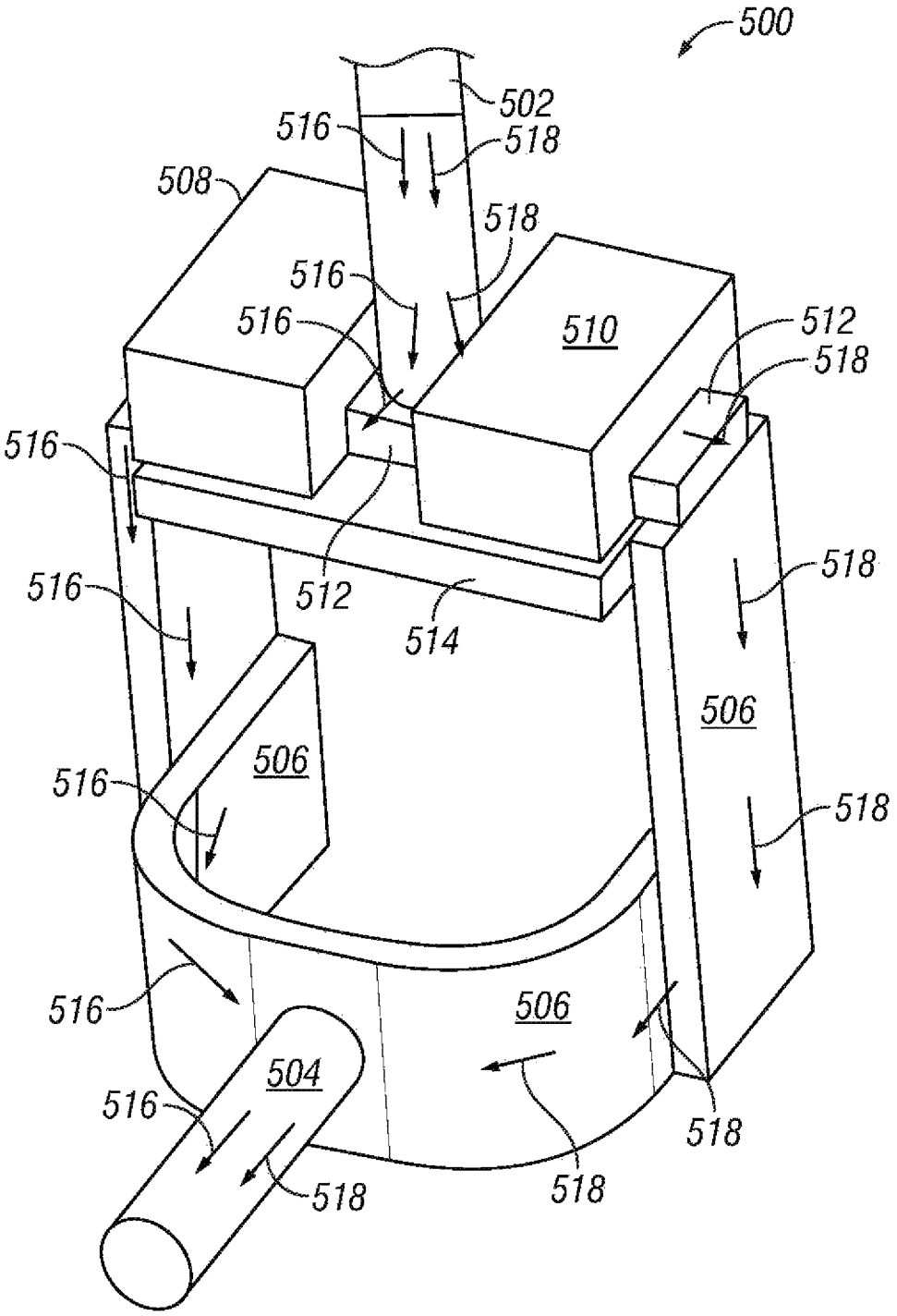
FIG. 5A is a diagram illustrating a prospective view of another example magnetic module, in the form of an example electromagnet assembly, for producing a blow-on contact force on the contacts of a single VI.
Figure 5C:
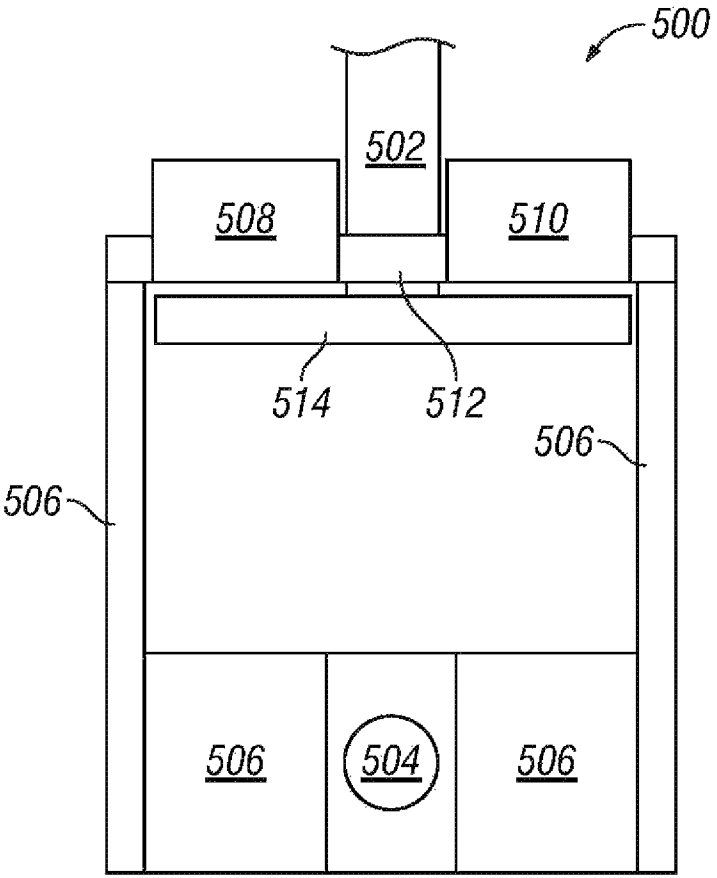
FIG. 5C is a diagram illustrating a front view of the example electromagnet assembly, in accordance with some embodiments.
Figure 5B:
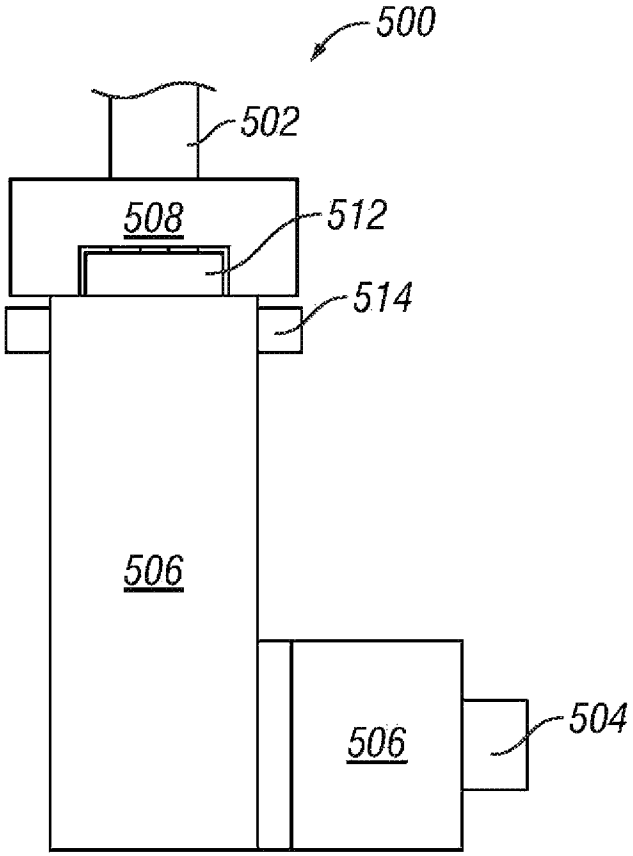
FIG. 5B is a diagram illustrating a side view of the example electromagnet assembly.

FIG. 5A is a diagram illustrating a prospective view of another example magnetic module, in the form of an example electromagnet assembly 500, for producing a blow-on contact force on the contacts of a single VI in an example circuit interrupting system (e.g., circuit breaker or switch). FIG. 5B is a diagram illustrating a side view of the example electromagnet assembly 500. FIG. 5C is a diagram illustrating a front view of the example electromagnet assembly 500. The example electromagnet assembly 500 is configured for use in a vacuum interrupter (VI) to generate a blow-on force on VI contacts to counteract blow-off forces on the VI contacts. The example electromagnet assembly 500 is configured to generate an attractive magnetic force that is harnessed as a blow-on force. The example electromagnetic assembly 500 is electrically connected, on one end, to a VI moving stem 502, for example, through Balseal contact spring(s) (not shown) or Multilams (not shown). The example electromagnetic assembly 500 is connected, on its other end, to a switch terminal 504 by auxiliary conductors 506. The example electromagnet assembly 500 includes two stationary laminated magnetic cores 508, 510, an electromagnet coil conductor 512, and a plunger 514, in addition to the auxiliary conductors 506, which connect the electromagnet coil conductor 512 and the switch terminal 504. The two stationary laminated magnetic cores 508, 510 are mounted around two halves of the coil conductor 512. The plunger 514 is fastened to the VI moving stem 502.

In an example illustration of operation when the VI is conducting current, the current path and current direction through the electromagnetic assembly 500 are indicated by the two sets of arrows 516, 518. The total VI current, in this example, is divided into two equal (or near equal) currents—one current 516 flows through the left portion of the electromagnet coil conductor 512 to the terminal 504, and the other current 518 flows through the right portion of the electromagnet coil conductor 512 to the terminal 504. Each current 516, 518 magnetizes the corresponding stationary core 508, 510 positioned around it, the portion of the plunger 514 in its vicinity and an air gap between the core 508, 510 and the plunger 514. This creates attractive magnetic force between each stationary core 508, 510 and the plunger 514. Due to geometrical symmetry and approximately equal division of current, the attractive force between the stationary core 508 and the plunger 514 is approximately equal to the attractive force between the stationary core 510 and the plunger 514. These two attractive forces acting on the plunger 514 work to pull the plunger 514 axially closer to the electromagnet cores 508, 510. The total force (sum of the two attractive forces) acting on the plunger, presses on the VI moving stem 502 axially and creates a blow-on force on the VI contacts.

In this example, the electromagnet coil 512 has only one turn but, in case of fault, coil current 516, 518 is high and, therefore, there is sufficient magnetomotive force to create high magnetic flux in the magnetic circuit and very substantial attractive force on the plunger 514. In this example, the conductor material for all of the conductors 506, 512 are copper to reduce heating due to Ohmic losses. The stationary cores 508, 510 and plunger 514, in this example are made of laminated steel sheets to reduce eddy current effects, but they could also be made from other material such as solid steel or a sintered magnetic material with high B (magnetic flux density) saturation and low electrical conductivity.

Figure 6B:
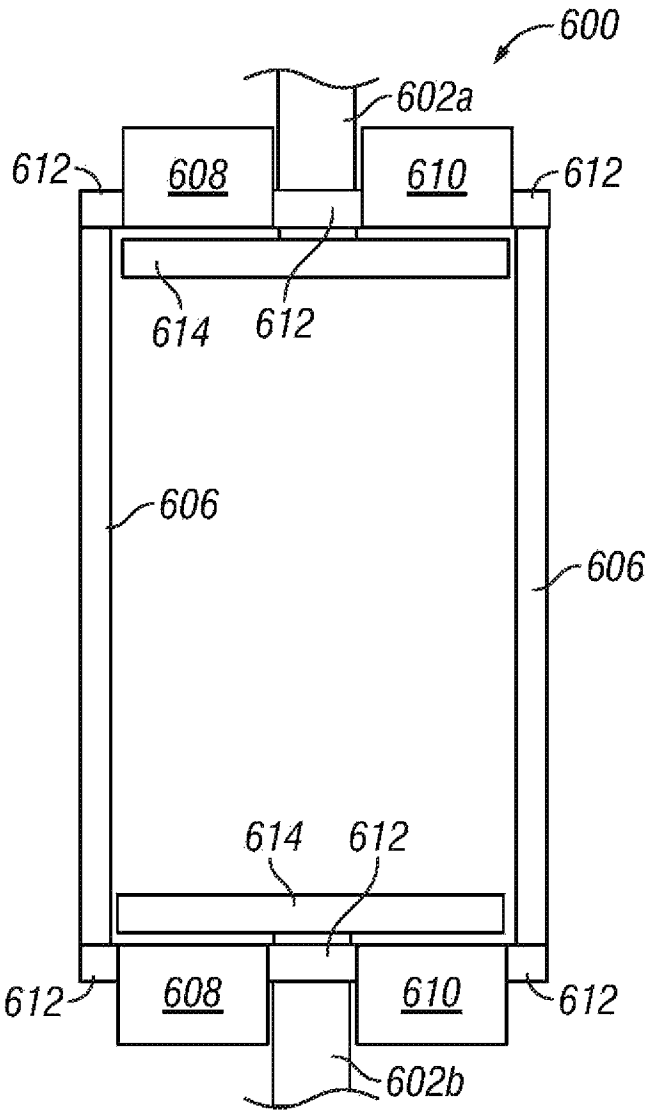
FIG. 6B is a diagram illustrating a front view of the example electromagnet assembly, in accordance with some embodiments.
Figure 6A:
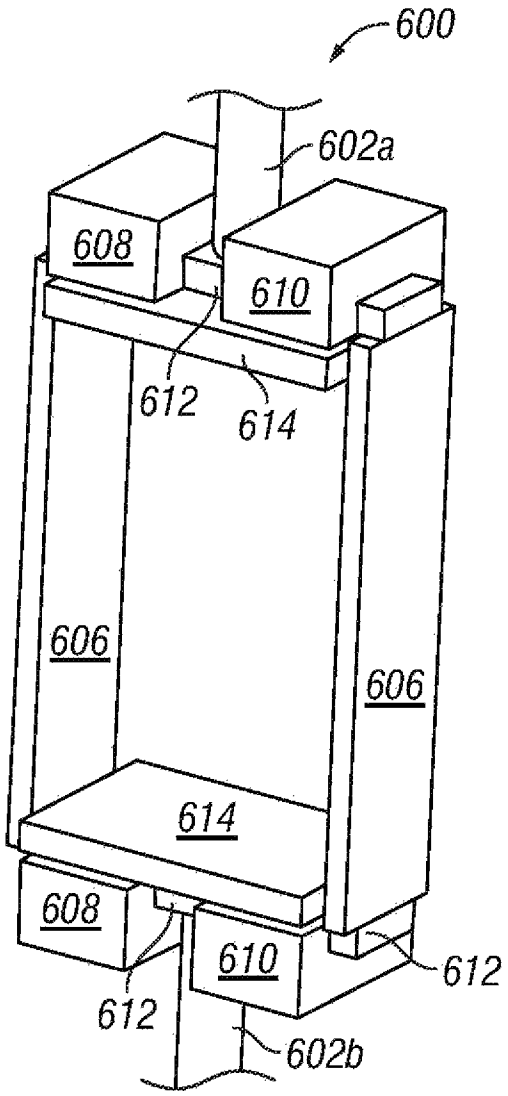
FIG. 6A is a diagram illustrating a prospective view of an example electromagnet assembly for producing blow-on contact force on the contacts of two vacuum interrupters connected in series.

FIG. 6A is a diagram illustrating a prospective view of an example electromagnet assembly 600 for producing blow-on contact force on the contacts of two vacuum interrupters connected in series in an example circuit interrupting system (e.g., circuit breaker or switch). FIG. 6B is a diagram illustrating a front view of the example electromagnet assembly 600. A separate electromagnet assembly 601*a*, 601*b* is attached, respectively, to a moving stem 602*a*, 602*b* of a different vacuum interrupter. Each example electromagnet assembly 601*a*, 601*b* is similar to the example electromagnet assembly 500 in form and function. Each electromagnet assembly 601*a*, 601*b* is electrically connected, on one end, to a VI moving stem 602*a*, 602*b*, for example, through Balseal contact spring(s) (not shown) or Multilams (not shown). Each electromagnet assembly 601*a*, 601*b* includes two stationary laminated magnetic cores 608, 610, an electromagnet coil conductor 612, a plunger 614, and auxiliary conductors 606. The two stationary laminated magnetic cores 608, 610, in each electromagnet assembly 601*a*, 601*b*, are mounted around two halves of the coil conductor 612. The plunger 614, in each electromagnet assembly 601*a*, 601*b*, is fastened to its associated VI moving stem 602*a*, 602*b*.

Each electromagnet assembly 601*a*, 601*b*, differs from the example electromagnet assembly 500 in that the electromagnet coil conductor 612 of each electromagnet assembly 601*a*, 601*b* is connected, on its other end, by auxiliary conductors 606 to the electromagnet coil conductor 612 of the other electromagnet assembly 601*a*, 601*b* rather than connecting them to a terminal.

In an example illustration of operation when the two vacuum interrupters are conducting current, the total VI current is divided into two equal (or near equal) currents. One current flows from the moving stem 602*a* through the left portion of the electromagnet coil conductor 612 for the example electromagnet assembly 601*a* through the auxiliary conductor 606 to the left portion of the electromagnet coil conductor 612 for the example electromagnet assembly 601*b* and finally to the moving stem 602*b*. The other current flows through the right portion of the electromagnet coil conductor 612 for the example electromagnet assembly 601*a* through the auxiliary conductor 606 to the right portion of the electromagnet coil conductor 612 for the example electromagnet assembly 601*b* and finally to the moving stem 602*b*. Each of these two currents magnetizes the corresponding stationary core 608, 610 positioned around it, the portion of the plunger 614 in its vicinity and an air gap between the cores 608, 610 and the plunger 614. This creates attractive magnetic force between each stationary core 608, 610 and the associated plunger 614. Due to geometrical symmetry and approximately equal division of current, the attractive forces between the stationary cores 608 and the plungers 614 are approximately equal to the attractive forces between the stationary cores 610 and the plungers 614. These attractive forces acting on the plungers 614 work to pull the plungers 614 axially closer to their respective electromagnet cores 608, 610. The total forces (sum of the attractive forces) acting on the plungers 614, press on the VI moving stems 602*a*, 602*b* axially and create blow-on forces on the VI contacts.

The subject matter described herein provides an architecture wherein fault current flowing through a vacuum interrupter can be used to generate blow-on forces to counteract contact blow-off forces. The subject matter described provides both a conductor assembly and an electromagnet assembly that can be used to provide blow-on forces for contacts in: (1) vacuum load switches that have to close on very high fault current (e.g., $I_{fault}$>25 kA) or on any lower level of fault current; (2) vacuum capacitor switches that have to close on very high fault current (e.g., $I_{fault}$>25 kA) or on any lower level of fault current; (3) switches that that have excessive blow-off forces acting on contacts; (4) vacuum circuit breakers that have to close on very high fault current ($I_{fault}$>25 kA) or on any lower level of fault current; (5) circuit breakers that that have excessive blow-off force acting on contacts; and (6) high voltage vacuum switches and circuit breakers with series connected vacuum interrupters.

For the sake of brevity, conventional techniques related to vacuum load switches, switches, vacuum circuit breakers, circuit breakers, high voltage vacuum switches and circuit breakers with series connected vacuum interrupters, power distribution systems and other functional aspects of the systems (and the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in an embodiment of the subject matter.

The foregoing description may refer to elements or components or features being "coupled" together. As used herein, unless expressly stated otherwise, "coupled" means that one element/node/feature is directly or indirectly joined to (or directly or indirectly communicates with) another element/node/feature, and not necessarily mechanically. Thus, although the drawings may depict one exemplary arrangement of elements with direct electrical connections, additional intervening elements, devices, features, or components may be present in an embodiment of the depicted subject matter. In addition, certain terminology may also be used in the following description for the purpose of reference only, and thus are not intended to be limiting. For example, the terms "first," "second," and other such numerical terms referring to structures do not imply a sequence or order unless clearly indicated by the context.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the subject matter in any way. Rather, the foregoing detailed description will provide those skilled in the art with a convenient road map for implementing an exemplary embodiment of the subject matter. It should be understood that various changes may be made in the function and arrangement of elements described in an exemplary embodiment without departing from the scope of the subject matter as set forth in the appended claims. As an example, the subject matter described herein for generating blow-on forces are also applicable to devices other than vacuum interrupter devices, such as other devices having contacts, in circuit breakers and switches, that can experience contact blow-off forces. Accordingly, details of the exemplary embodiments or other limitations described above should not be read into the claims absent a clear intention to the contrary.

What is claimed is:

1. A magnetic module for generating a blow-on force using fault current, the magnetic module comprising:

a moving coil comprising a first moving coil arc section and attached to a moving stem of a moving contact;

a stationary coil comprising a first stationary coil arc section that is coupled to a first auxiliary conductor; and a current transfer strap positioned to electrically connect the first moving coil arc section to the first stationary coil arc section; and wherein the moving coil, stationary coil, and current transfer strap are positioned to allow current to flow from the moving stem to the first auxiliary conductor;

wherein the current transfer strap and the first auxiliary conductor are positioned to cause a current to flow in the first stationary coil arc section in a direction opposite to a current flow in the first moving coil section; and wherein the moving coil and stationary coil are positioned such that current flow through the first moving coil arc section and the first stationary coil arc section generates a force that pushes the moving coil away from the stationary coil and the moving stem of the moving contact toward a stationary contact.

2. The magnetic module of claim 1, wherein:

the moving coil comprises a second moving coil arc section;

the stationary coil comprises a second stationary coil arc section that is coupled to a second auxiliary conductor; and a second current transfer strap is positioned to electrically connect the second moving coil arc section to the second stationary coil arc section; and wherein the moving coil, stationary coil, and second current transfer strap are positioned to allow current to flow from the moving stem to the second auxiliary conductor;

wherein the second current transfer strap and the second auxiliary conductor are positioned to cause a current flow in the second stationary coil arc section in a direction opposite to a current flow in the second moving coil arc section; and wherein the moving coil and stationary coil are positioned such that current flow through the second moving coil arc section and the second stationary coil arc section generates a force that pushes the moving coil away from the stationary coil and the moving stem of the moving contact toward the stationary contact.

3. The magnetic module of claim 2, wherein:

the first stationary coil arc section and the second stationary coil arc section are configured to define a void in the stationary coil having an inner diameter; and the first moving coil arc section and the second moving coil arc section are configured to define an outer diameter that is smaller than the inner diameter of the stationary coil to allow the moving coil to move in close proximity axially to the stationary coil without mechanical interference.

4. The magnetic module of claim 3, wherein:

the first stationary coil arc section is physically separated from the second stationary coil arc section;

the first moving coil arc section is connected to a center of the moving coil by a first radial straight segment and the second moving coil arc section is connected to the center of the moving coil by a second radial straight segment; and an end of the first moving coil arc section is physically separated from an end of the second moving coil arc section.

5. The magnetic module of claim 2, wherein the stationary coil is coupled to a terminal of a vacuum interrupter via the first auxiliary conductor and the second auxiliary conductor.

6. The magnetic module of claim 1, further comprising:

a second moving coil comprising a third moving coil arc section and attached to a second moving stem of a second moving contact;

a second stationary coil comprising a third stationary coil arc section that is coupled to a third auxiliary conductor; and a third current transfer strap positioned to electrically connect the third moving coil arc section to the third stationary coil arc section; and wherein the second moving coil, second stationary coil, and third current transfer strap are positioned to allow current to flow from the third auxiliary conductor to the second moving stem;

wherein the third current transfer strap and the third auxiliary conductor are positioned to cause a current flow in the third stationary coil arc section in a direction opposite to a current flow in the third moving coil section; and wherein the second moving coil and second stationary coil are positioned such that current flow through the third moving coil arc section and the third stationary coil arc section generates a force that pushes the second moving coil away from the second stationary coil and the second moving stem of the second moving contact toward a second stationary contact.

7. The magnetic module of claim 6, wherein:

the second moving coil comprises a fourth moving coil arc section;

the second stationary coil comprises a fourth stationary coil arc section that is coupled to a fourth auxiliary conductor; and a fourth current transfer strap is positioned to electrically connect the fourth moving coil arc section to the fourth stationary coil arc section; and wherein the second moving coil, second stationary coil, and fourth current transfer strap are positioned to allow current to flow from the fourth auxiliary conductor to the second moving stem;

wherein the fourth current transfer strap and the fourth auxiliary conductor are positioned to cause a current flow in the fourth stationary coil arc section in a direction opposite to a current flow in the fourth moving coil arc section; and wherein the second moving coil and second stationary coil are positioned such that current flow through the fourth moving coil arc section and the fourth stationary coil arc section generates a force that pushes the second moving coil away from the second stationary coil and the second moving stem of the second moving contact toward the second stationary contact.

8. A magnetic module for generating a blow-on force using fault current, the magnetic module comprising:

a coil conductor having an opening through which a moving stem of a moving contact may move, wherein the coil conductor is electrically connected to the moving stem and a first auxiliary conductor, wherein the coil conductor is configured to allow current to flow from the moving stem to the first auxiliary conductor;

a plunger constructed from magnetic attractive material attached to an end of the moving stem; and a first magnetic core shaped to fit around a first section of the coil conductor, wherein the first magnetic core is configured, when current flows through the coil conductor to the first auxiliary conductor, to become magnetized, attract the plunger in an axial direction toward the first magnetic core, and cause the moving stem of the moving contact to move toward a stationary contact.

9. The magnetic module of claim 8, wherein:

the coil conductor is further electrically connected to a second auxiliary conductor, wherein the coil conductor is further configured to allow current to flow from the moving stem to the second auxiliary conductor; and further comprising a second magnetic core shaped to fit around a second section of the coil conductor, wherein the second magnetic core is configured, when current flows through the coil conductor to the second auxiliary conductor, to become magnetized, attract the plunger in the axial direction toward the first magnetic core, and cause the moving stem of the moving contact to move toward the stationary contact.

10. The magnetic module of claim 9, wherein the coil conductor, first auxiliary conductor, and second auxiliary conductor are configured to cause an approximately equal amount of current from the moving stem to flow to the first auxiliary conductor and the second auxiliary conductor.

11. The magnetic module of claim 10, wherein the first magnet core and the second magnet cores are configured with geometric symmetry around the coil conductor.

12. The magnetic module of claim 11, wherein the magnetic module is configured to generate, when current flows through the moving stem, an attractive magnetic force between the first magnetic core and plunger that is approximately equal to an attractive magnetic force between the second magnetic core and the plunger.

13. The magnetic module of claim 9, wherein the coil conductor is coupled to a terminal of a vacuum interrupter via the first auxiliary conductor and the second auxiliary conductor.

14. The magnetic module of claim 10, further comprising:

a second coil conductor having an opening through which a second moving stem of a second moving contact may move, wherein the second coil conductor is electrically connected to the second moving stem and a third auxiliary conductor, wherein the second coil conductor is configured to allow current to flow from the third auxiliary conductor to the second moving stem;

a second plunger constructed from magnetic attractive material attached to an end of the second moving stem; and a third magnetic core shaped to fit around a first section of the second coil conductor, wherein the third magnetic core is configured, when current flows through the third auxiliary conductor to the second coil conductor, to become magnetized, attract the second plunger in an axial direction toward the third magnetic core, and cause the second moving stem of the second moving contact to move toward a second stationary contact.

15. The magnetic module of claim 14, wherein:

the second coil conductor is further electrically connected to a fourth auxiliary conductor, wherein the second coil conductor is further configured to allow current to flow from the fourth auxiliary conductor to the second moving stem; and further comprising a fourth magnetic core shaped to fit around a second section of the second coil conductor, wherein the fourth magnetic core is configured, when current flows through the fourth auxiliary conductor to the second coil conductor, to become magnetized, attract the second plunger in the axial direction toward the fourth magnetic core, and cause the second moving stem of the second moving contact to move toward the second stationary contact.

16. The magnetic module of claim 15, wherein the second coil conductor, third auxiliary conductor, and fourth auxiliary conductor are configured to cause an approximately equal amount of current to flow from the third auxiliary conductor and the fourth auxiliary conductor to the second moving stem.

17. The magnetic module of claim 16, wherein the third magnetic core and the fourth magnetic cores are configured with geometric symmetry around the second coil conductor.

18. The magnetic module of claim 17, wherein the magnetic module is configured to generate, when current flows through the second moving stem, an attractive magnetic force between the third magnetic core and second plunger that is approximately equal to an attractive magnetic force between the fourth magnetic core and the second plunger.

19. A circuit interrupting system comprising:

a moving stem connected to a moving contact;

a stationary contact; and a magnetic module configured to generate a magnetic force that pushes the moving contact toward the stationary contact using fault current, the magnetic module comprising:

a coil conductor having an opening through which the moving stem of the moving contact may move, wherein the coil conductor is electrically connected to the moving stem and a first auxiliary conductor, wherein the coil conductor is configured to allow current to flow from the moving stem to the first auxiliary conductor;

a plunger constructed from magnetic attractive material attached to an end of the moving stem; and a first magnetic core shaped to fit around a first section of the coil conductor, wherein the first magnetic core is configured, when current flows through the coil conductor to the first auxiliary conductor, to become magnetized, attract the plunger in an axial direction toward the first magnetic core, and cause the moving stem of the moving contact to move toward the stationary contact.

20. A circuit interrupting system comprising:

a moving stem connected to a moving contact;

a stationary contact; and a magnetic module configured to generate a magnetic force that pushes the moving contact toward the stationary contact using fault current, the magnetic module comprising:

a moving coil comprising a first moving coil arc section and attached to the moving stem of the moving contact;

a stationary coil comprising a first stationary coil arc section that is coupled to a first auxiliary conductor; and a current transfer strap positioned to electrically connect the first moving coil arc section to the first stationary coil arc section; and wherein the moving coil, stationary coil, and current transfer strap are positioned to allow current to flow from the moving stem to the first auxiliary conductor;

wherein the current transfer strap and the first auxiliary conductor are positioned to cause a current flow in the first stationary coil arc section in a direction opposite to a current flow in the first moving coil section; and wherein the moving coil and stationary coil are positioned such that current flow through the first moving coil arc section and the first stationary coil arc section generates a force that pushes the moving coil away from the stationary coil and the moving stem of the moving contact toward the stationary contact.

* * * * *